US006656066B2

(12) United States Patent
Barker

(10) Patent No.: US 6,656,066 B2
(45) Date of Patent: Dec. 2, 2003

(54) LIGHTED STRAP ASSEMBLY FOR A BALL

(76) Inventor: Michael Joseph Barker, 101 Southbrook La., Arden, NC (US) 28732

( * ) Notice: Subject to any disclaimer, the term of this patent is extended or adjusted under 35 U.S.C. 154(b) by 0 days.

(21) Appl. No.: 10/198,244

(22) Filed: Jul. 18, 2002

(65) Prior Publication Data

US 2003/0017891 A1 Jan. 23, 2003

Related U.S. Application Data

(60) Provisional application No. 60/306,225, filed on Jul. 18, 2001.

(51) Int. Cl.[7] ..... A63B 43/06
(52) U.S. Cl. ..... 473/570; 273/DIG. 24
(58) Field of Search ..... 473/570, 571, 473/603; 273/DIG. 24; 446/47

(56) References Cited

U.S. PATENT DOCUMENTS 2,011,760 A 8/1935 Gallinant
4,086,723 A 5/1978 Strawick
4,479,649 A 10/1984 Newcomb et al.
4,930,776 A 6/1990 Newcomb et al.
4,979,751 A 12/1990 Sullivan, III
5,186,458 A * 2/1993 Redondo ..... 473/570
5,370,390 A 12/1994 Swanson
5,403,000 A * 4/1995 Woosley ..... 473/570
5,683,316 A 11/1997 Campbell
5,882,239 A 3/1999 Trichak

* cited by examiner

*Primary Examiner*—Steven Wong
(74) *Attorney, Agent, or Firm*—Adams Evans P.A.

(57) ABSTRACT

A harness assembly for being removably positioned on a ball and used for retaining an elongate luminescent member on the ball is provided that includes a pair of collars positioned in spaced-apart, opposing relation to each other for receiving the ball therebetween. The harness further includes support segments adapted for receiving opposing ends of the luminescent member therein, thereby retaining the luminescent member by the ends thereof in a tensioned condition relative to the harness assembly when the harness assembly is in use.

19 Claims, 14 Drawing Sheets

LIGHTED STRAP ASSEMBLY FOR A BALL

This application claims priority from U.S. Provisional Application No. 60/306,225, filed Jul. 18, 2001 for a "Lighted Strap Assembly for a Ball".

TECHNICAL FIELD AND BACKGROUND OF THE INVENTION

This invention relates to a lighted strap assembly for use on a ball. The strap assembly utilizes flexible, chemiluminescent light tubes which may be positioned on the strap assembly in one of a number of preselected configurations relative to the strap assembly and the ball upon which the strap assembly is positioned. Use of the chemiluminescent light tubes on the strap assembly illuminates the ball for use in dim light, or for play in the dark. The light tubes are arranged on the strap assembly such that when the ball is thrown in the darkness, portions of the ball appear illuminated. The light tubes are held in place on the strap assembly by tubular support segments, which permit the light tubes to be positioned relative to the strap assembly for changing the configuration of the light tubes and the pattern of illumination relative to the ball. Use of the tubular support segments also permits the light tubes to be easily removed and replaced when the luminescent capabilities of the light tubes are exhausted.

SUMMARY OF THE INVENTION

Therefore, it is an object of the invention to provide a lighted strap assembly for use on a ball, including but not limited to a football, rugby ball, or other ball intended for recreational use.

It is another object of the invention to provide a lighted strap assembly for use on a ball which utilizes chemiluminescent light sticks arranged in a decorative configuration relative to the exterior surface of the ball.

It is another object of the invention to provide a lighted strap assembly for use on a ball which has light sources which are easy and relatively inexpensive to replace.

It is another object of the invention to provide a lighted strap assembly that may be quickly and easily positioned around a ball.

It is another object of the invention to provide a lighted strap assembly having flexible lights capable of being positioned and repositioned on the strap assembly in one or more preselected configurations.

It is another object of the invention to provide a lighted strap assembly having flexible lights that are interchangeable and available in multiple colors.

It is another object of the invention to provide a lighted strap assembly which includes a flexible harness that serves as an enhanced gripping surface for use in throwing the ball.

These and other objects of the invention are described in the preferred embodiments disclosed below by providing a harness assembly for being removably positioned on a ball and used for retaining an elongate luminescent member on the ball. The harness assembly includes a pair of collars positioned in spaced-apart, opposing relation to each other for receiving the ball therebetween and retention means carried by the harness assembly and adapted for receiving opposing ends of the luminescent member therein. The retention means retain the luminescent member by the ends thereof in a tensioned condition relative to the harness assembly when the harness assembly is in use.

According to one preferred embodiment of the invention, the retention means is a first pair of anchors. Each of the anchors has a pocket for receiving a respective one of the opposing ends of the luminescent member therein.

According to another preferred embodiment of the invention, each of the pair of anchors is carried by a respective one of the collars for permitting the luminescent member to extend and be supported therebetween.

According to yet another preferred embodiment of the invention, the harness assembly includes an elongate strap interconnecting said collars and cooperating therewith for maintaining the harness assembly against the ball.

According to yet another preferred embodiment of the invention, the pair of anchors are carried by the strap for permitting the luminescent member to extend parallel thereto.

According to yet another preferred embodiment of the invention, the harness assembly includes at least one elongate strap interconnecting the collars and cooperating therewith for maintaining the harness assembly against the ball.

According to yet another preferred embodiment of the invention, each of the pair of anchors has a closed end for retaining an end of the luminescent member, thereby maintaining the luminescent member in a stationary position on the harness assembly.

According to yet another preferred embodiment of the invention, the closed end of each anchor is disposed between an inner surface of a respective one of the collars and an outer surface of the strap for permitting the pocket on the anchor to extend outwardly away from the collar.

According to yet another preferred embodiment of the invention, a harness assembly for being removably positioned on a ball and used for retaining an elongate luminescent member on the ball is provided that includes a pair of collars positioned in spaced-apart, opposing relation to each other for receiving the ball therebetween. An elongate strap interconnects the collars and cooperates therewith for maintaining the harness assembly in a closely-conforming configuration against the ball. A pair of anchors are carried by the harness assembly. Each of the pair of anchors has a pocket for receiving a respective one of two opposing ends of the luminescent member therein, thereby retaining the luminescent member by the ends thereof in a tensioned condition relative to the harness assembly when the harness assembly is in use.

According to yet another preferred embodiment of the invention, the pair of anchors are carried by the strap for permitting the luminescent member to extend parallel thereto.

According to yet another preferred embodiment of the invention, each of the pair of anchors has a depth sufficient for retaining no more than twelve percent of the total surface area of the luminescent member, thereby maximizing an exposed surface area of the luminescent member for illuminating the ball.

According to yet another preferred embodiment of the invention, each of the pair of anchors is carried by a respective one of the pair of collars for permitting the luminescent member to extend and be supported therebetween.

According to yet another preferred embodiment of the invention, a harness assembly is provided for being removably positioned on a football and used for illuminating the ball. The harness assembly includes an elongate chemiluminescent tube adapted for being removably positioned on the harness assembly, and a pair of collars positioned in spaced-apart, opposing relation to each other for receiving tapered, opposing noses of the football therethrough. A pair of anchors are carried by the harness assembly. Each of the pair of anchors has a pocket for receiving a respective one of two opposing ends of the chemiluminescent tube therein, thereby retaining the chemiluminescent tube in a tensioned condition relative to the harness assembly when the harness assembly is in use.

According to yet another preferred embodiment of the invention, the harness assembly includes first and second elongate straps interconnecting the pair of collars and cooperating therewith for maintaining the harness assembly against the ball.

According to yet another preferred embodiment of the invention, the pair of anchors are positioned in spaced-apart relation on the first elongate strap for permitting the chemiluminescent tube to extend and be supported between the anchors and parallel to the first strap.

According to yet another preferred embodiment of the invention, each of the pair of anchors is carried by a respective one of the pair of collars for permitting the chemiluminescent tube to extend and be supported therebetween.

According to yet another preferred embodiment of the invention, each of the first and second straps is adapted for conforming to the curved outer surface of the football for maintaining the chemiluminescent tube between the pair of collars and in a curved condition corresponding to the curved outer surface of the football.

According to yet another preferred embodiment of the invention, one of the pair of anchors is carried by the harness assembly adjacent a point of intersection of the first strap and one of the pair of collars, and the other of the pair of anchors is carried by the harness assembly adjacent a point of intersection of the second strap and the other of the pair of collars for permitting the luminescent member to extend and be supported between the pair of collars at an angle relative to each of the first and second straps.

According to yet another preferred embodiment of the invention, a method of illuminating a ball is provided. The method includes the step of providing a harness assembly for being removably positioned on a ball and used for retaining an elongate luminescent member in a preselected configuration on the ball. The harness assembly includes a pair of collars positioned in spaced-apart, opposing relation to each other for receiving the ball therebetween. A pair of anchors are carried by the harness assembly. Each of the pair of anchors has a pocket for receiving a respective one of two opposing ends of the luminescent member therein, thereby retaining the luminescent member in a tensioned condition relative to the harness assembly when the harness assembly is in use. The method also includes the step of providing an elongate luminescent member having opposing ends, each of the ends for being removably positioned within the pocket on a respective one of the pair of anchors. The harness assembly is positioned on the ball, and the opposing ends of the luminescent member are positioned within respective pockets on the pair of anchors, thereby illuminating the ball.

According to another preferred embodiment of the invention, the method of illuminating a ball further comprises the step of providing a ball for receiving the harness assembly thereon.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
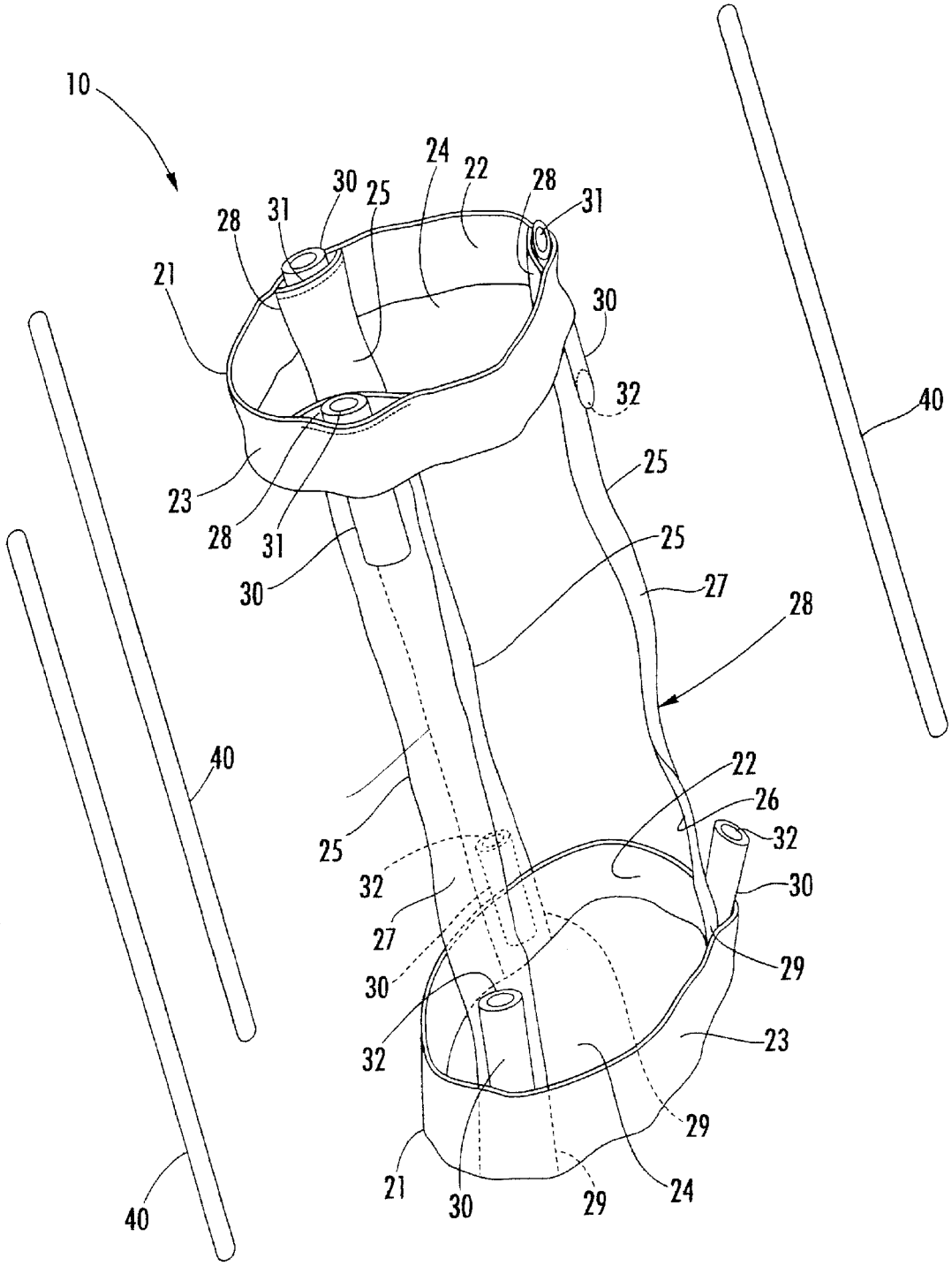
FIG. 1 is a partially exploded perspective view of a lighted strap assembly for use on a ball according to one preferred embodiment of the invention.

Referring now to the drawings, a lighted strap assembly according to one embodiment of the present invention is illustrated in FIG. 1 and shown generally at reference numeral 10. The strap assembly 10 is shown partially assembled, and includes a flexible harness 20, multiple tubular support segments 30, and multiple chemiluminescent light sticks 40. The harness 20 includes first and second identical attachment collars 21 which are positioned in spaced-apart, opposing relation to each other. Each attachment collar 21 has interior and exterior surfaces 22 and 23, respectively, and is preferably formed from an elongate strap of material having interconnected ends and interior and exterior surfaces 22 and 23. As discussed in detail below with respect to FIG. 2, each attachment collar 21 defines an opening 24 adapted for receiving a respective one of the ends of a football therethrough. The collars 21 cooperate with the other components of the harness 20 for holding the strap assembly 10 in place around the football.

Referring again to FIG. 1, the harness 20 also includes three flexible, elongate support straps 25 which are disposed between and interconnect the attachment collars 21. Each support strap 25 has interior and exterior surfaces 26 and 27, and first and second ends 28 and 29. As is shown in FIG. 1, the first ends 28 and second ends 29 of each strap 25 are connected to a respective one of the collars 21 such that the exterior surface 28 of each end 27 engages the interior surface 22 of one collar 21, and the exterior surface 26 of each end 29 engages the interior surface 22 of the other collar 21. Although the harness 20 is shown with three support straps 25, any desired number of support straps 25 may be used.

Although each collar 21 and support strap 25 may be formed from any suitable material, each collar 21 and support strap 25 is preferably formed from elasticized or woven, knitted fabric. Furthermore, the first ends 27 and second ends 28 are preferably sewn to the respective collars 21 using thread having a tensile strength sufficient to withstand breaking when the strap assembly 10 is being positioned around a football or other type of ball.

The strap assembly 10 also includes multiple tubular support segments 30. As discussed in detail with reference to FIGS. 2 through 8 below, the support segments 30 cooperate with the harness 20 to hold the lighted tubes 40 in one of multiple possible configurations against the outer surface of the football. Each tube 40 is preferably an elongate, flexible chemiluminescent light tube sold under the name OMNIGLO. However, the tubes 40 may alternatively be any other suitable chemiluminescent light sources. As is shown in FIG. 1, a tubular segment 30 is positioned adjacent each of the ends 28 and 29 of each strap 25 so that the segment 30 extends parallel to the longitudinal axis of the strap 25. Each tubular segment 30 defines a hollow interior and has a sealed end 31 which is sandwiched between and sewn in place or otherwise secured against the interior surface 22 of the collar 21 and the exterior surface 27 of the strap 25. Each tubular segment 30 also includes an open end 32 that extends outwardly from the sealed end 31 and toward the opposing collar 21. Each open end 32 is adapted for receiving the complementary end of a respective one of the light tubes 40 therein after the strap assembly 10 is positioned on the football for holding the light tubes 40 in place in one of at least two possible preselected configurations around the football. Although the harness 10 is shown as including three light tubes 40, the harness 10 may include any number of light tubes 40 and complementary pairs of tubular segments 30.

As is shown in FIG. 1, positioning the tubular segments 30 on opposite ends of each strap 25 so that the open ends 32 of the segments 30 face each other permits easy installation and removal of the light tubes onto the strap assembly 10. Furthermore, use flexible material to form the collars 21 and straps 25 permits movement of the open ends 32 of the support segments 30 relative to the collars 21 and straps 25. While the support segments 30 may be formed from any suitable material, each segment 30 is preferably formed from a preselected length of opaque or see-through plastic tubing.

Figure 2:
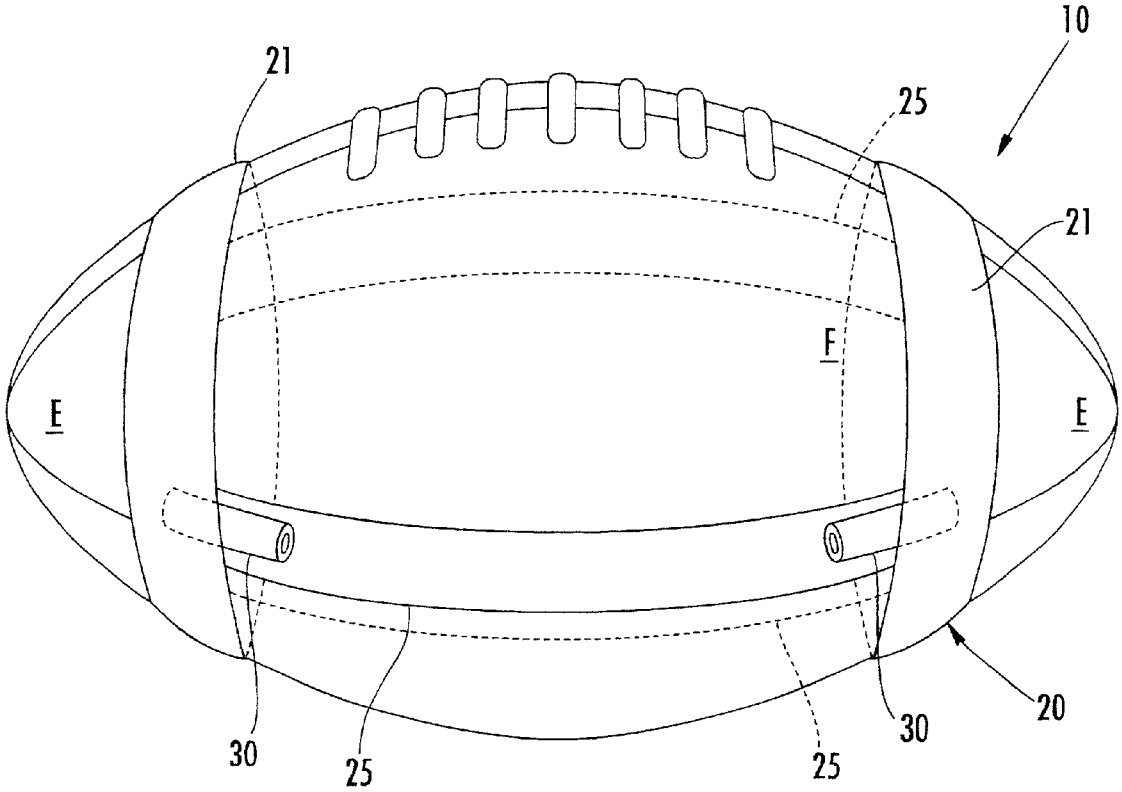
FIG. 2 is an environmental side view of the lighted strap assembly according to FIG. 1 prior to attaching the light sticks to the strap assembly and with the strap assembly placed in position on a football.

Referring now to FIG. 2, the manner in which the strap assembly 10 is positioned on a football "F" is shown. FIG. 2 shows the harness 20 positioned around the football so that each attachment collar 21 encircles a respective one of the opposing ends "E" of the football "F", and each of the support straps 25 extends partially along the length of the football "F" between the collars 21.

Figure 3:
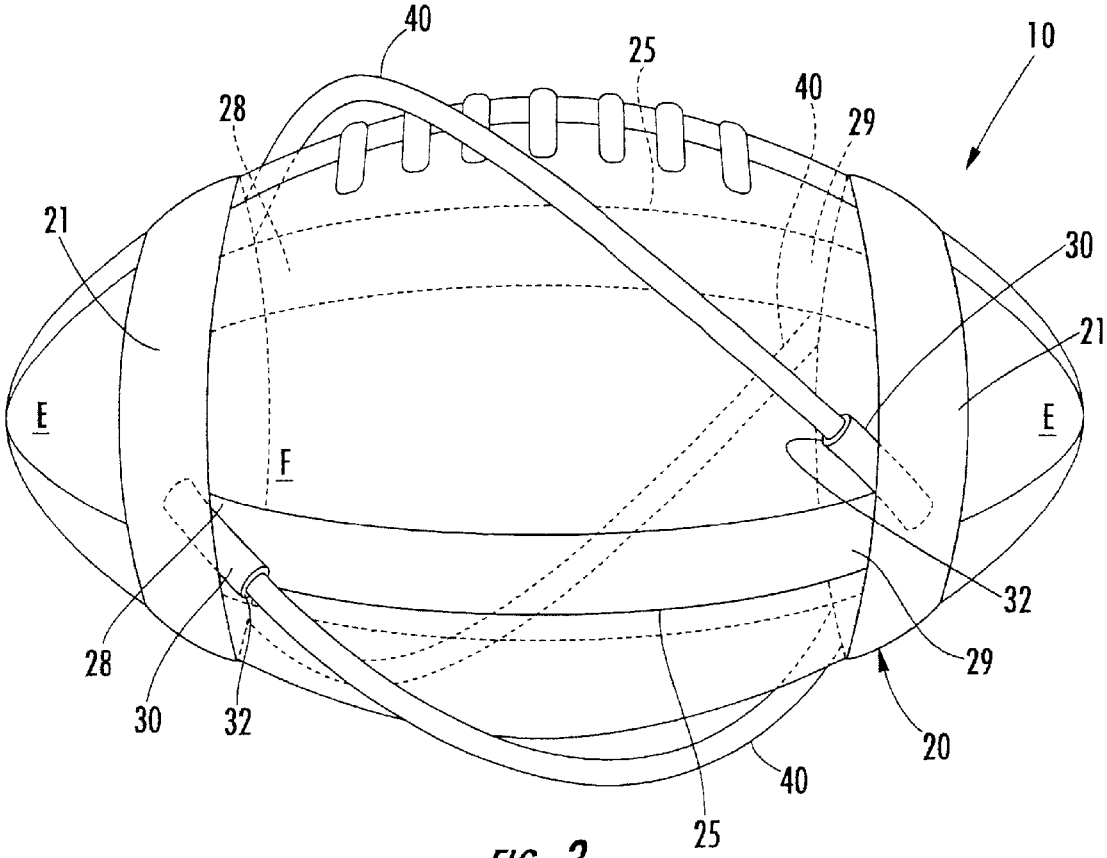
FIG. 3 is an environmental side view of the lighted strap assembly shown in FIG. 2 with chemiluminescent light sticks placed thereon according to one preferred embodiment of the invention.
Figure 4:
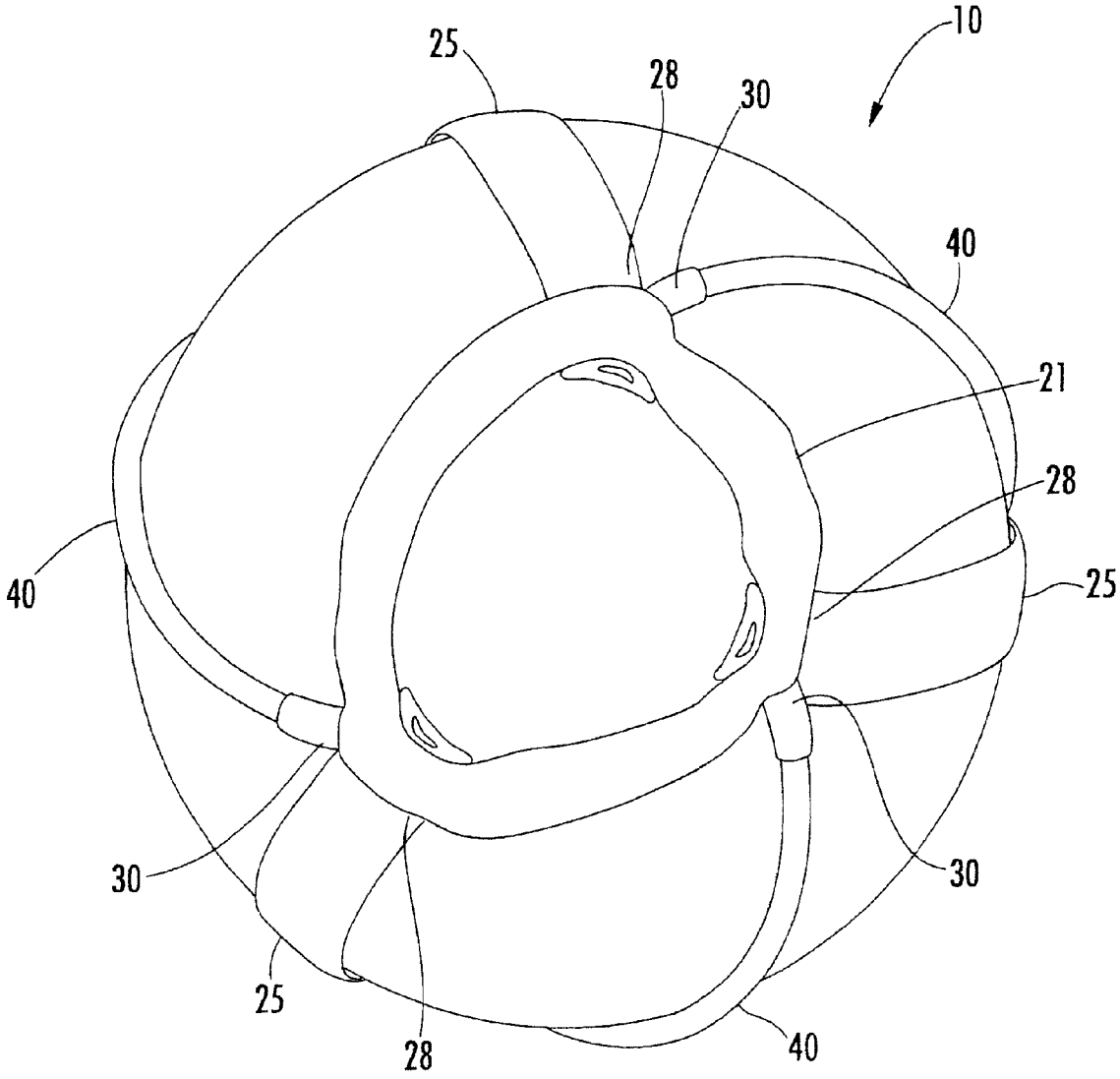
FIG. 4 is an end view of the lighted strap assembly and football shown in FIG. 3.

Referring now to FIGS. 3 through 6, once the harness 20 is positioned on the football "F", each tube 40 may be inserted into a respective one of a pair of tubular segments 30. Prior to inserting the tubes 40 into the segments 30, the chemiluminescent material inside the tubes 40 should be activated by snapping, bending and/or twisting each tube 40 until the material inside begins to glow. The chemiluminescent material inside each tube 40 may emit light in any one of the colors in the electromagnetic spectrum which is visible to the human eye. As is shown in FIGS. 3 through 6, the tubes 40 may be arranged in one of a number of preselected configurations relative to the harness 20 and to the football "F". One preferred configuration is shown in FIGS. 3 and 4, in which each light tube 40 is releasably connected to the harness 20 such that one end of the light tube 40 is positioned in a support tube 30 which is attached to a first end 28 of one support strap 25, and the other end of the light tube 40 is positioned in a support tube 30 which is attached to a second end 29 of an adjacent support strap 25. Attaching each light tube 40 to the harness 20 in this manner causes the activated light tubes 40 to glow in a spiraling pattern relative to the longitudinal axis of the football "F".

Figure 5:
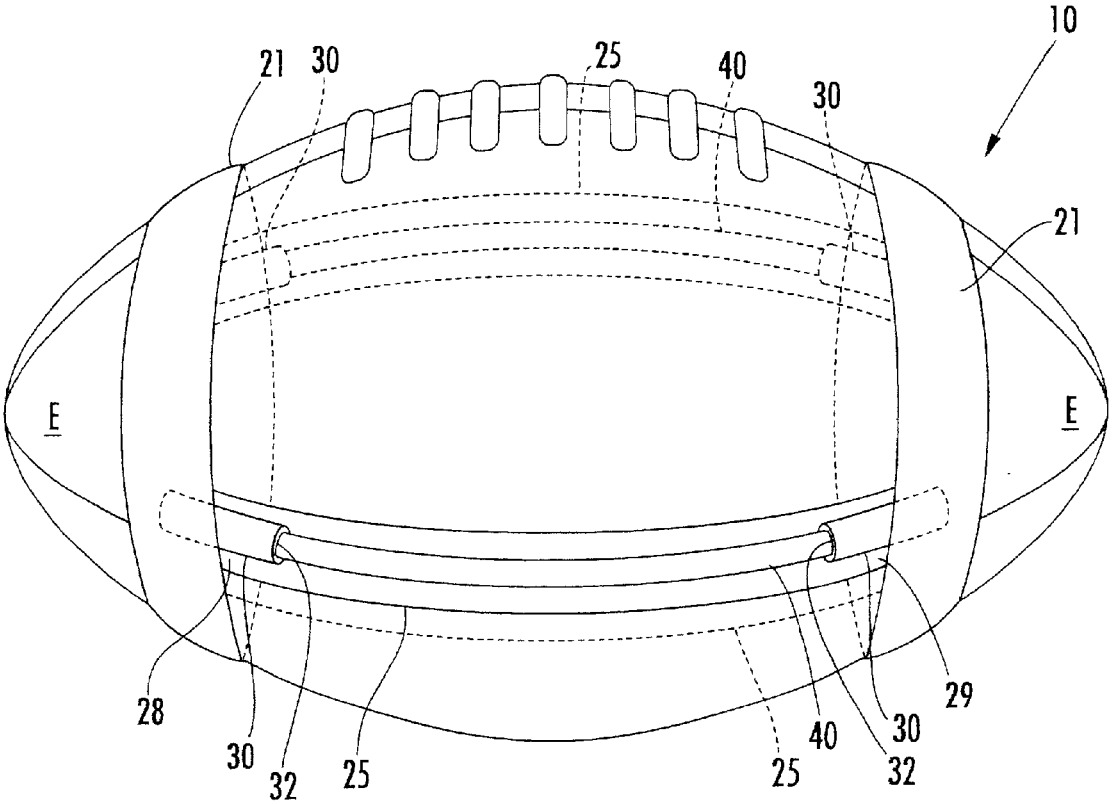
FIG. 5 is an environmental side view of the lighted strap assembly shown in FIG. 2 with the light sticks placed thereon according to another preferred embodiment of the invention.
Figure 6:
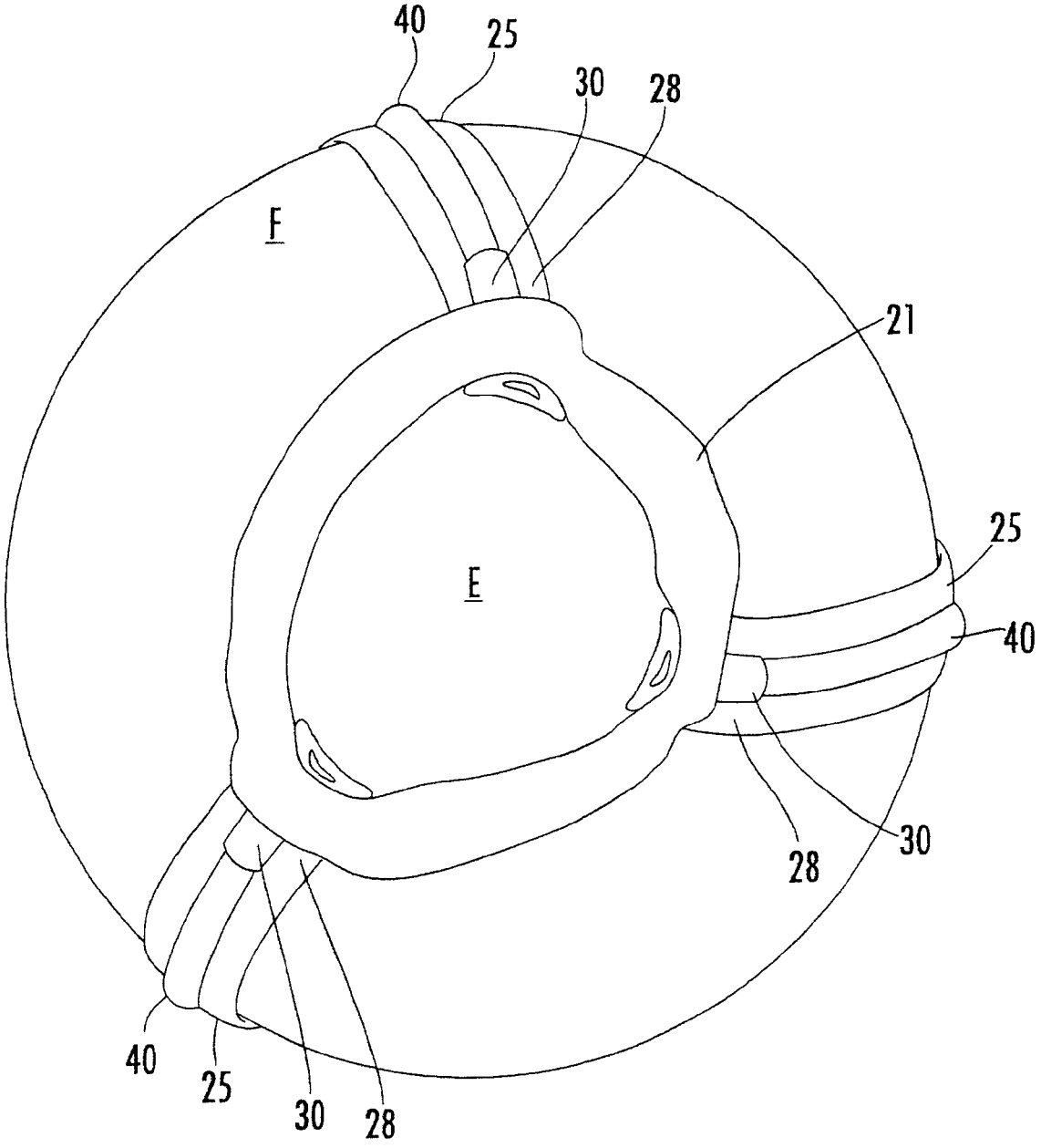
FIG. 6 is an end view of the lighted strap assembly and football shown in FIG. 5.

Referring now to FIGS. 5 and 6, the light tubes 40 are shown releasably connected to the harness 20 in an alternative configuration. Specifically, each light tube 40 is connected to the harness 20 such that the light tube 40 extends along the length of a respective one of the support straps 25, with each end of the light tube 40 positioned in a respective one of the open ends 32 of support tubes 30 which are connected to respective first and second ends 28 of the strap 25. Attaching each light tube 40 to the harness 20 in this manner causes the activated light tubes 40 to glow in a straight line relative to the longitudinal axis of the football "F".

Figure 7:
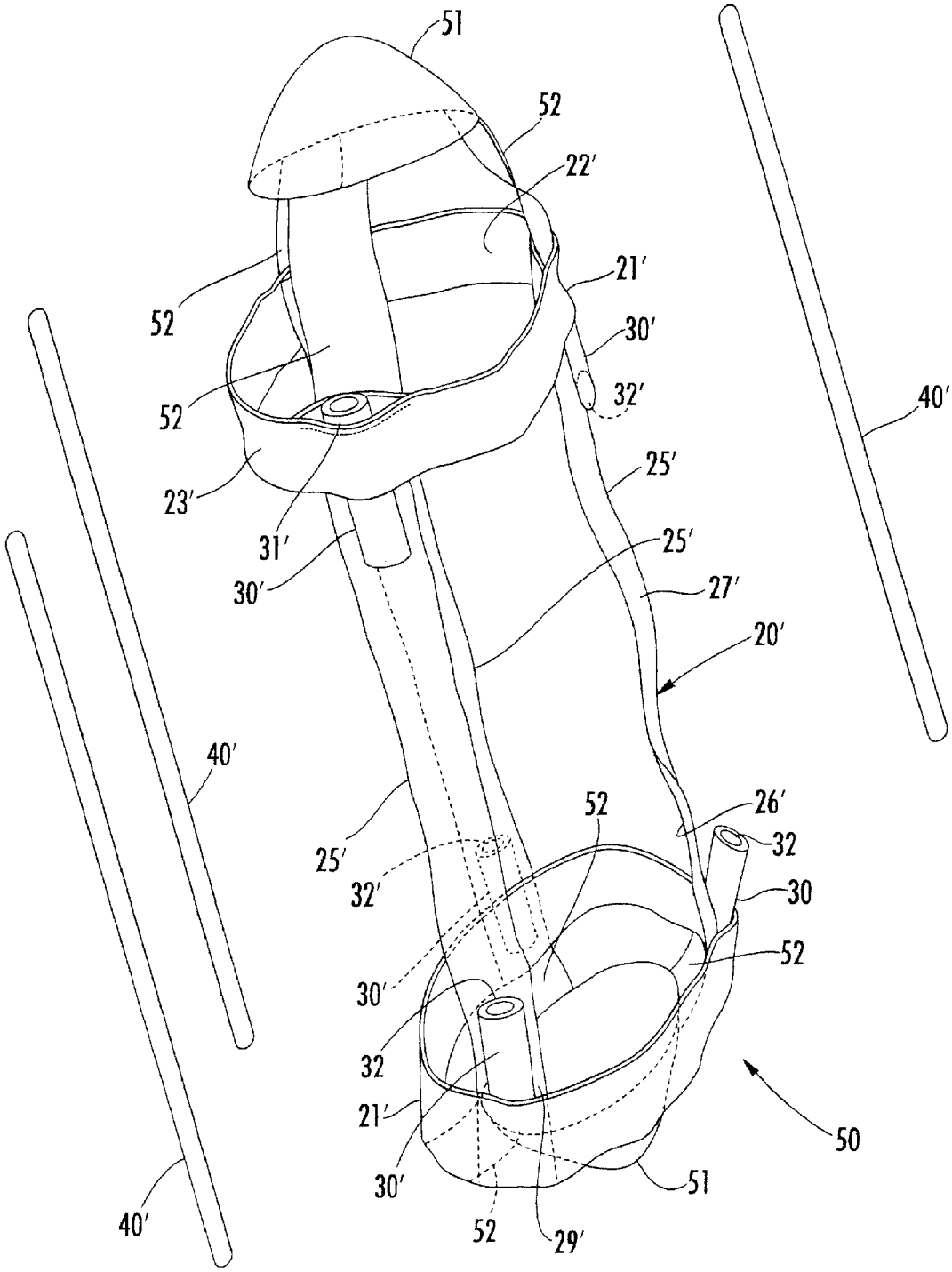
FIG. 7 is a partially exploded perspective view of a lighted strap assembly according to another preferred embodiment of the invention.

Referring now to FIGS. 7 through 12, a lighted strap assembly according to another preferred embodiment of the invention is illustrated and shown generally at reference numeral 50. Because the strap assembly 50 includes many of the same components, each of which is formed from the same materials, as the components included in the strap assembly 10, like elements are indicated using prime reference numerals. As is shown in FIG. 7, in addition to those components included in the strap assembly 10, the strap assembly 50 includes two end caps 51. Each end cap 51 preferably has a generally conical shape for permitting the cap 51 to cover and engage the end of a football or other ball. FIG. 7 shows each end cap 51 connected to a respective one of the attachment collars 21' by three straps 52. Each end cap 51 is preferably formed from see-through plastic and defines a hollow interior filed with the same chemiluminescent material as is used in light tubes 40 and 40'. Prior to positioning the strap assembly 50 on a football, the material is activated by bending and/or twisting each cap 51 until the material inside the cap 51 begins to glow. Like the material inside the tubes 40, the chemiluminescent material inside each cap 51 may emit light in any one of the colors in the electromagnetic spectrum which is visible to the human eye Referring now to FIG. 8, the manner in which the strap assembly 50 is positioned on a football "F" is shown. The harness 20' is positioned around the football "F" in a manner that permits each attachment collar 21' to encircle a respective one of the opposing ends "E" of the football "F" so that the end cap 51 attached to the collar 21' covers the end "E", which makes the end "E" appear to glow. Like the straps 25 of the strap assembly 10, each of the support straps 25' of the strap assembly 50 extends at least partially along the length of the football "F" between the collars 21'.

Figure 8:
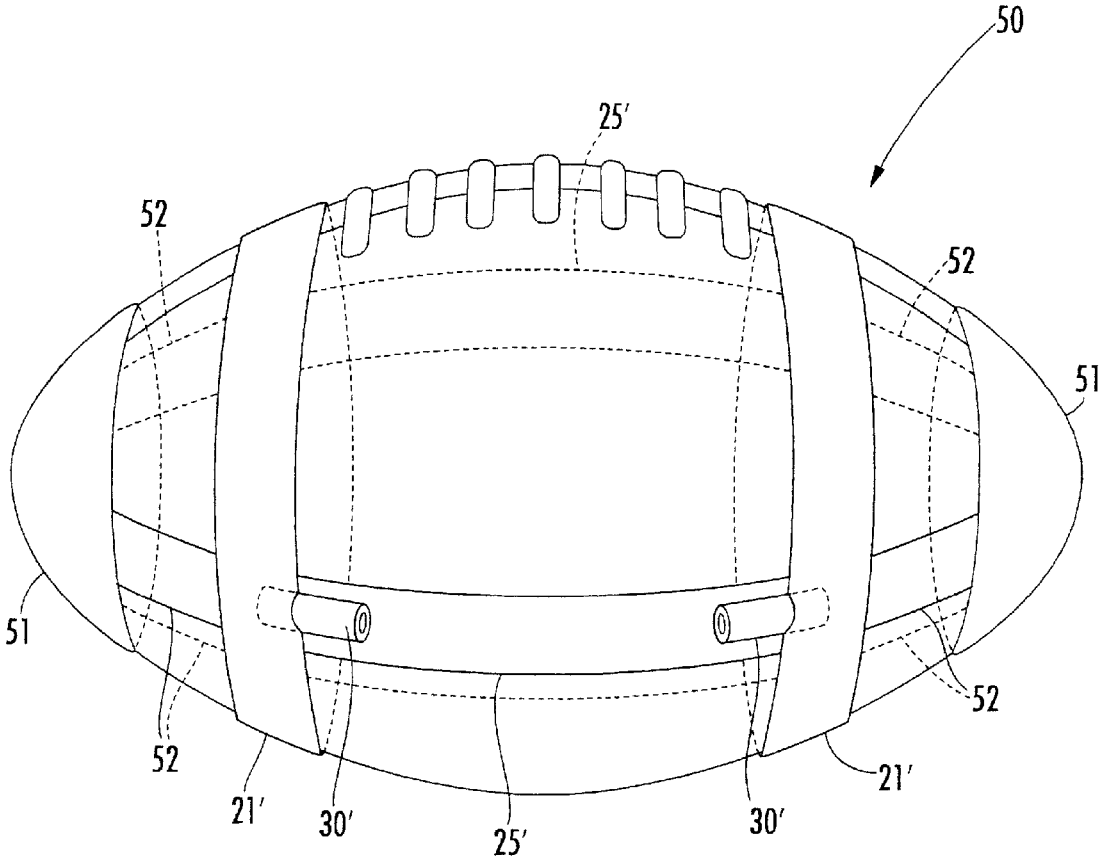
FIG. 8 is an environmental side view of the lighted strap assembly according to FIG. 7 prior to attaching the light sticks to the strap assembly and with the strap assembly placed in position on a football.
Figure 9:
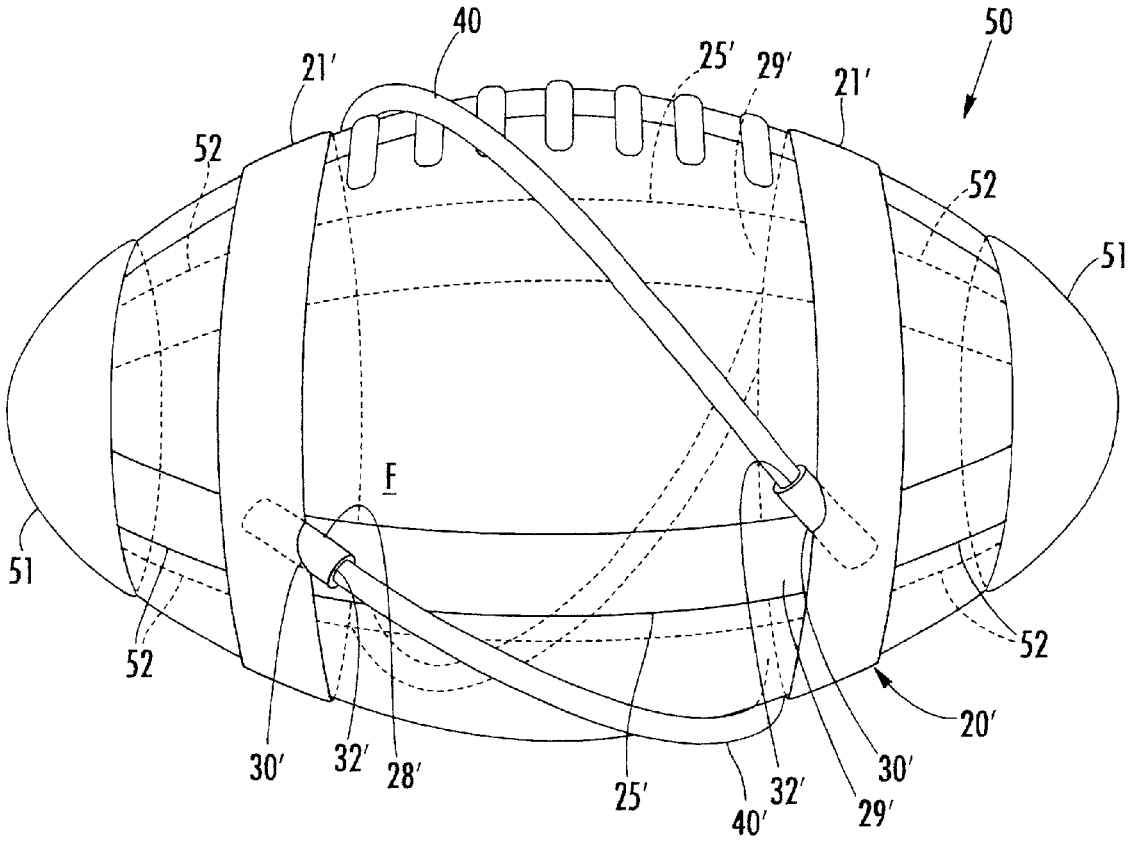
FIG. 9 is an environmental side view of the lighted strap assembly shown in FIG. 8 with the light sticks placed thereon according to an alternative embodiment of the invention.
Figure 10:
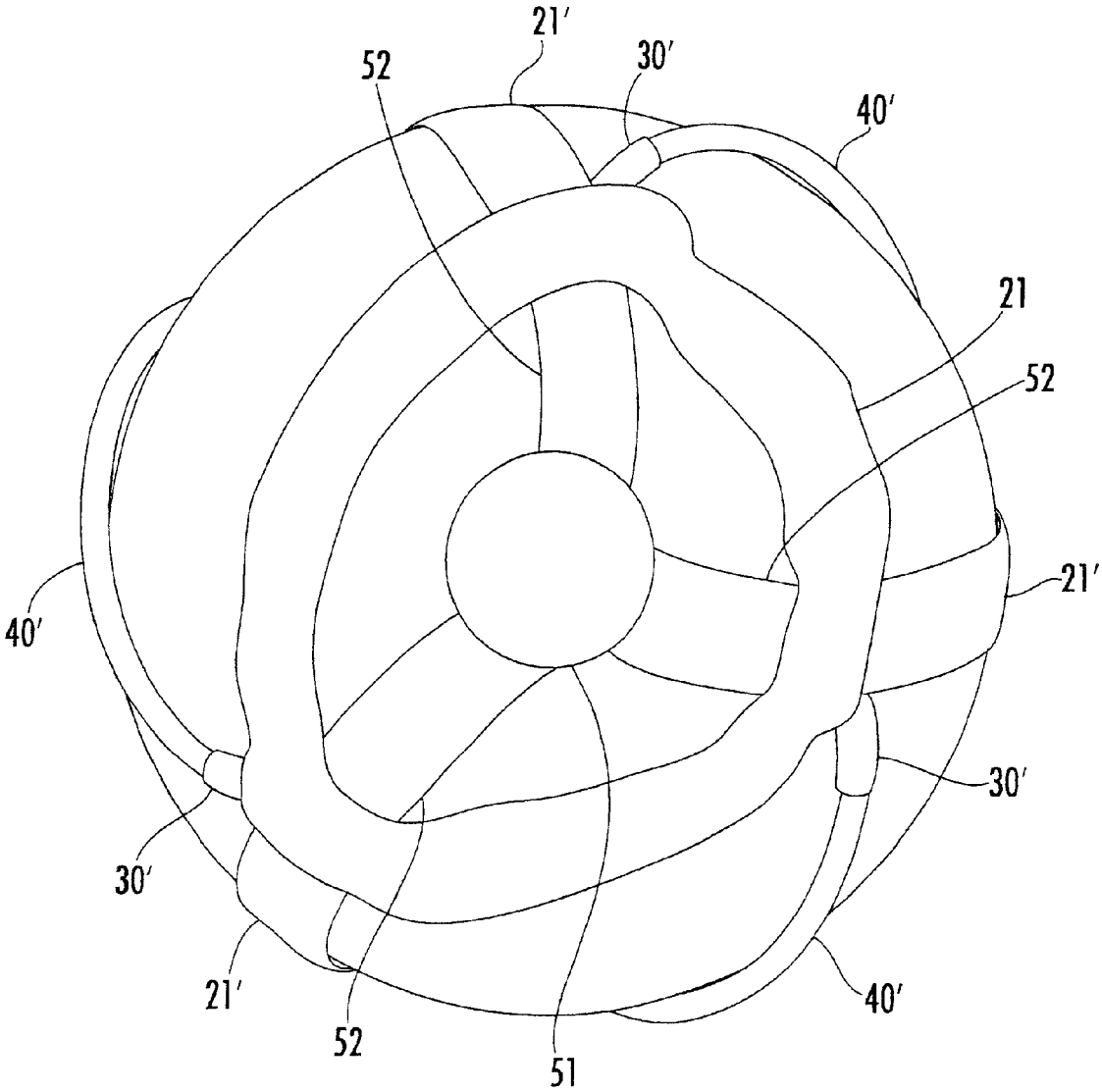
FIG. 10 is an end view of the lighted strap assembly and football shown in FIG. 9.

Referring now to FIGS. 9 and 10, the strap assembly 50 is shown positioned on a football "F" with the light sticks 40' positioned one of a number of preselected configurations relative to the harness 20' and to the football "F". As is shown in FIG. 8, each light tube 40' is activated in the same manner as the tubes 40 and described above in reference to FIGS. 3 through 6, and is then releasably connected to the harness 20' such that one end of the light tube 40' is positioned in a support tube 30' to the first end 28' of one support strap 25'. The other end of the light tube 40' is positioned in a support tube 30' attached to a second end 29' of an adjacent support strap 25'. Attaching each light tube 40' to the harness 20' in this manner causes the activated light tubes 40' to generate a glowing, spiral pattern relative to the longitudinal axis of the football "F".

Figure 11:
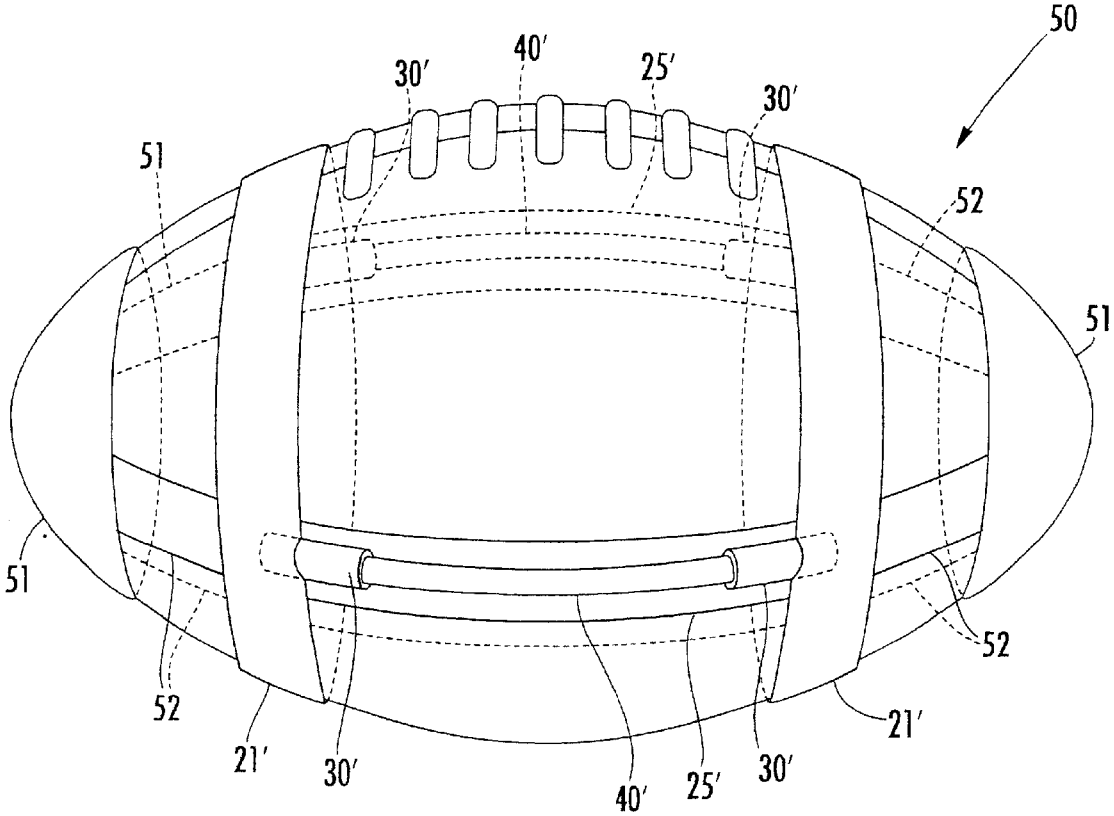
FIG. 11 is an environmental side view of the lighted strap assembly shown in FIG. 8 with the light sticks placed thereon according to an alternative embodiment of the invention.
Figure 12:
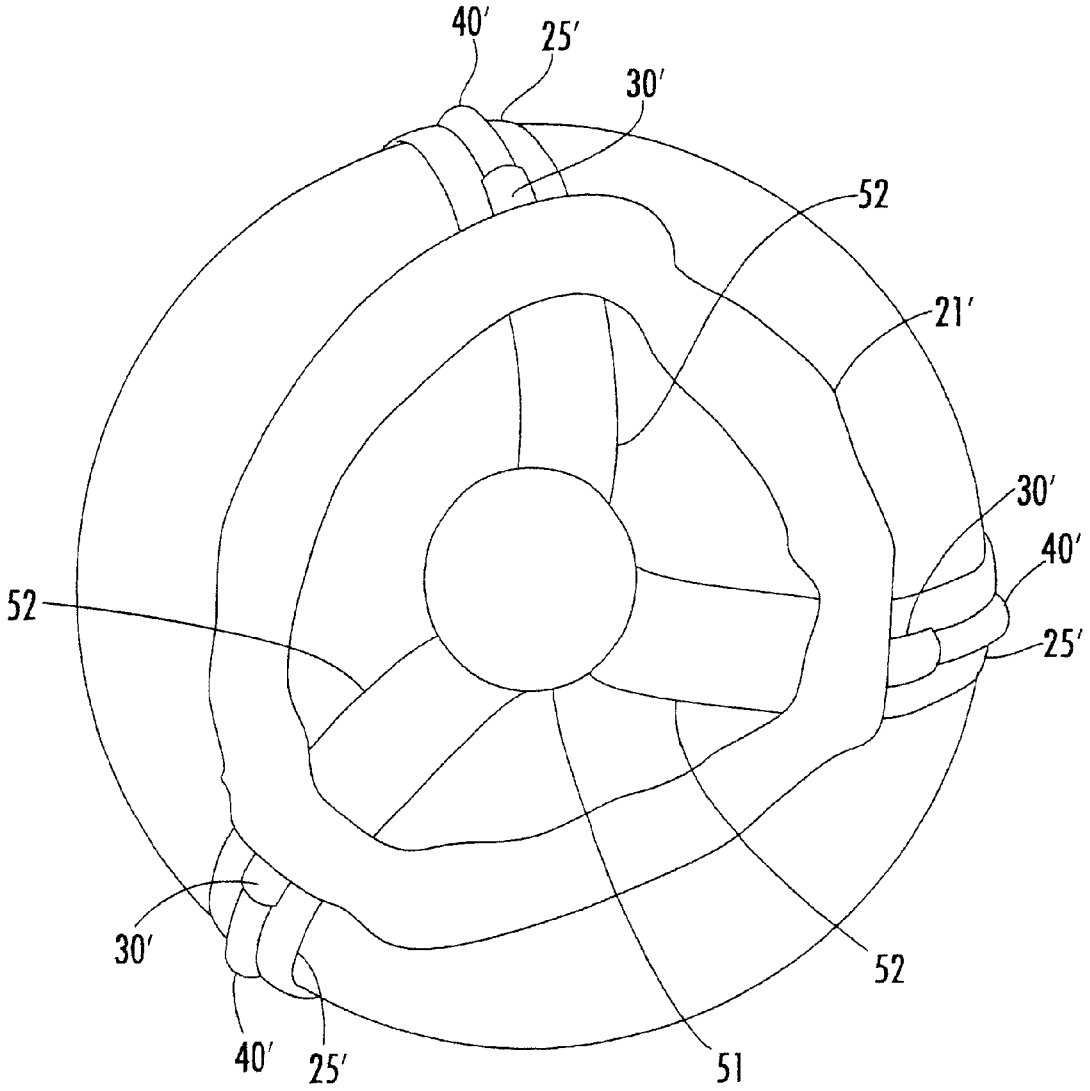
FIG. 12 is an environmental side view of the lighted strap assembly and football shown in FIG. 11.

Referring now to FIGS. 11 and 12, the light tubes 40' are shown releasably attached to the harness 20' in an alternative configuration. Specifically, each activated light tube 40' is connected to the harness 20' such that the light tube 40' extends along at least part of the length of a respective one of the support straps 25', with each end of the light tube 40' positioned in a respective one of the open ends 32' of the support tubes 30' which are connected to respective first and second ends 28' and 29' of the strap 25'. Attaching each light tube 40' to the harness 20' in this manner causes the activated light tubes 40' to glow in a straight line relative to the longitudinal axis of the football "F".

Figure 13:
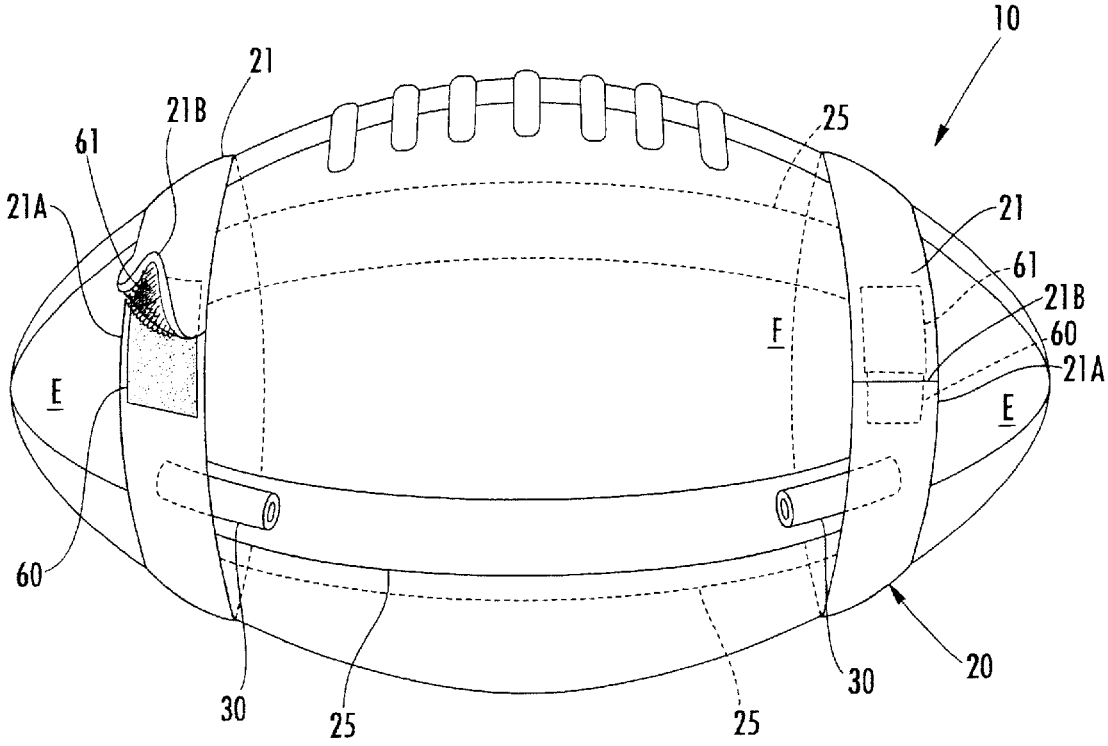
FIG. 13 is an environmental side view of a lighted strap assembly according to an alternative embodiment of the invention.
Figure 14:
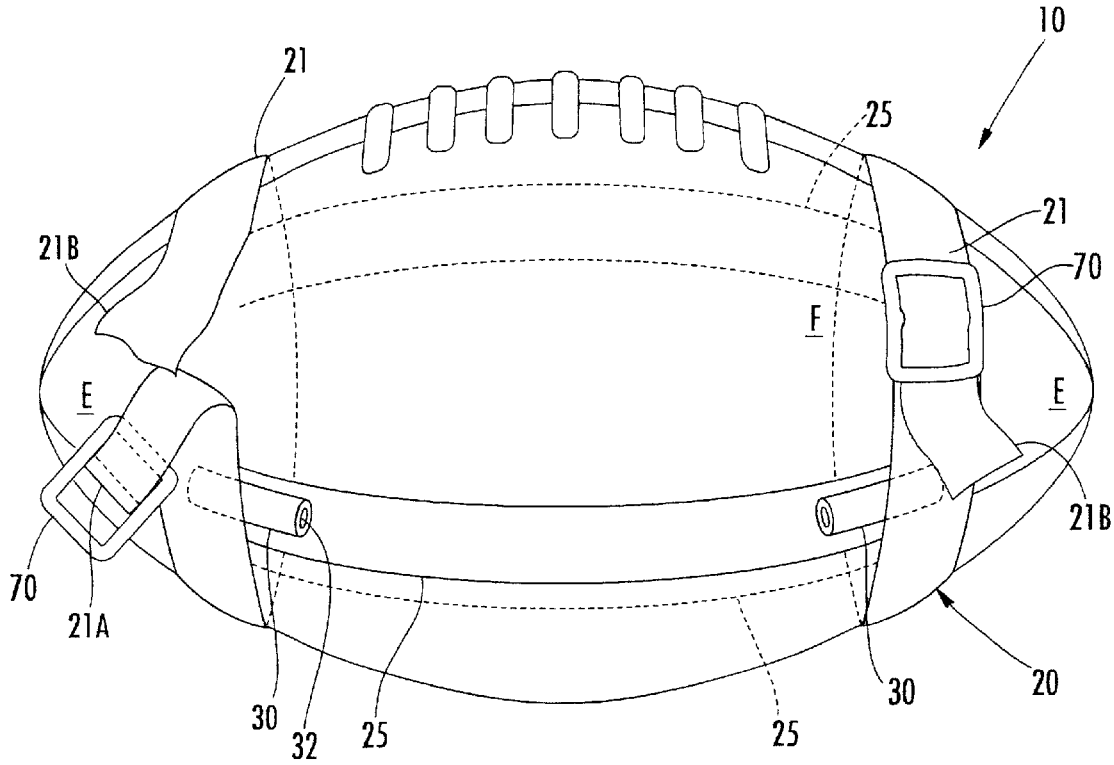
FIG. 14 is an environmental side view of a lighted strap assembly according to an alternative embodiment of the invention.

Referring now to FIGS. 13 and 14, each collar 21 or 21' of the strap assemblies 10 or 50, respectively, may alternatively include fasteners for keeping each collar 21 or 21' securely in position around the football and for adjusting the circumference of each collar 21 or 21'. Using strap assembly 10 as a representative example, FIG. 13 shows each collar 21 as having a first end 21A to which a first patch 60 of male or female hook-and-loop material is sewn or otherwise secured. A second patch 61 of male or female hook-and-loop material complementary to the first patch 60 is sewn to the second end 21B of the collar 21 and is releasably attached to the first patch 60 for keeping the strap assembly held in place around the football. Alternative fasteners are shown in FIG. 14. Using strap assembly 10 as a representative example, each collar 21 has a first end 21A to which a metal or plastic buckle 70 is connected. The second end 21B of the collar 21 fits into the buckle 70 for releasably securing the collar 21 around the football "F".

In addition to including fasteners on one or more of the collars 21 or 21', the strap assemblies 10 or 50 may alternatively include fasteners one or more of the support straps 25 or 25', respectively, for permitting the length of the strap 25 or 25' to be adjusted. The fasteners used to adjust the length of the straps 25 and 25' may be identical to the complementary hook-and-loop patches 60 and 61 shown in use on each of the collars 21 of strap assembly 10. Each strap 25 or 25' may alternatively employ a buckle 70 and include a complementary end adapted for being threaded through the buckle for adjusting the overall length of the respective strap 25 or 25'.

The strap assembly 10 or 50, may alternatively employ any other fasteners or latching devices which are suitable for adjusting the manner in which the collars 21 or 21', or straps respectively, fit around the circumference of the football "F". One or more of the support straps 25 or 25' may likewise alternatively employ any other fasteners or latching devices which are suitable for adjusting the length of respective support strap 25 or 25'. In addition, while the strap assemblies 10 and 50 are shown throughout this application in use on a football, the strap assemblies 10 and 50 may alternatively be used on rugby or any other suitable balls that are intended for recreational use.

A lighted strap assembly for use on a ball is described above. Various details of the invention may be changed without departing from its scope. Furthermore, the foregoing description of the preferred embodiments of the invention and the best mode for practicing the invention are provided for the purpose of illustration only and not for the purpose of limitation—the invention being defined by the claims.

I claim:

1. A harness assembly for being removably positioned on a ball and used for retaining an elongate luminescent member on the ball, comprising:

(a) a pair of collars positioned in spaced-apart, opposing relation to each other for receiving the ball therebetween; and (b) retention means carried by said harness and adapted for receiving opposing ends of the luminescent member therein, thereby retaining the luminescent member by the ends thereof in a tensioned condition relative to the harness assembly when the harness assembly is in use, wherein said retention means comprises a first pair of anchors, each of said anchors having a pocket for receiving a respective one of the opposing ends of the luminescent member therein.

2. A harness assembly according to claim 1, wherein each of the pair of anchors is carried by a respective one of the collars for permitting the luminescent member to extend and be supported therebetween.

3. A harness assembly according to claim 1, and including an elongate strap interconnecting said collars and cooperating therewith for maintaining the harness assembly against the ball.

4. A harness assembly according to claim 3, wherein said pair of anchors are carried by said strap for permitting the luminescent member to extend parallel thereto.

5. A harness assembly according to claim 1, and including at least one elongate strap interconnecting said collars and cooperating therewith for maintaining the harness assembly against the ball.

6. A harness assembly according to claim 5, wherein each of the pair of anchors has a closed end for retaining an end of the luminescent member, thereby maintaining the luminescent member in a stationary position on the harness assembly.

7. A strap assembly according to claim 6, wherein said closed end of each anchor is disposed between an inner surface of a respective one of the collars and an outer surface of the strap for permitting said pocket on the anchor to extend outwardly away from the collar.

8. A harness assembly for being removably positioned on a ball and used for retaining an elongate luminescent member on the ball, comprising:

(a) a pair of collars positioned in spaced-apart, opposing relation to each other for receiving the ball therebetween;

(b) an elongate strap interconnecting said collars and cooperating therewith for maintaining said harness assembly in a closely-conforming configuration against the ball; and (c) a pair of anchors carried by the harness assembly, each of said pair of anchors having a pocket for receiving a respective one of two opposing ends of the luminescent member therein, thereby retaining the luminescent member by the ends thereof in a tensioned condition relative to the harness assembly when the harness assembly is in use.

9. A harness assembly according to claim 8, wherein said pair of anchors are carried by said strap for permitting the luminescent member to extend parallel thereto.

10. A harness assembly according to claim 8, wherein each of said pockets has a depth sufficient for retaining no more than twelve percent of the total surface area of the luminescent member, thereby maximizing an exposed surface area of the luminescent member for illuminating the ball.

11. A harness assembly according to claim 8, wherein each of said pair of anchors is carried by a respective one of the pair of collars for permitting the luminescent member to extend and be supported therebetween.

12. A harness assembly for being removably positioned on a football and used for illuminating the football, comprising:

(a) an elongate chemiluminescent tube adapted for being positioned on said harness assembly;

(b) a pair of collars positioned in spaced-apart, opposing relation to each other for receiving tapered, opposing noses of the football therethrough; and (c) a pair of anchors carried by said harness assembly, each of said pair of anchors having a pocket for receiving a respective one of two opposing ends of said chemiluminescent tube therein, thereby retaining the chemiluminescent tube by the ends thereof in a tensioned condition relative to the harness assembly when the harness assembly is in use.

13. A harness assembly according to claim 12, and including first and second elongate straps interconnecting said pair of collars and cooperating therewith for maintaining the harness assembly against a curved outer surface of the football.

14. A harness assembly according to claim 13, wherein said pair of anchors are positioned in spaced-apart relation on said first elongate strap for permitting the chemiluminescent tube to extend and be supported between the anchors and parallel to the first strap.

15. A harness assembly according to claim 13, wherein each of the pair of anchors is carried by a respective one of the pair of collars for permitting the chemiluminescent tube to extend and be supported therebetween.

16. A harness assembly according to claim 15, wherein each of said first and second straps is adapted for conforming to the curved outer surface of the football for maintaining the chemiluminescent tube between the pair of collars and in a curved condition corresponding to the curved outer surface of the football.

17. A harness assembly according to claim 13, wherein one of said pair of anchors is carried by the harness assembly adjacent a point of intersection of said first strap and one of the pair of collars, and the other of the pair of anchors is carried by the harness assembly adjacent a point of intersection of said second strap and the other of the pair of collars for permitting the chemiluminescent tube to extend and be supported between the pair of collars at an angle relative to each of the first and second straps.

18. A method of illuminating a ball, comprising the steps of:

(a) providing a harness assembly for being removably positioned on a ball and used for retaining an elongate luminescent member in a preselected configuration on the ball, including:

(i) a pair of collars positioned in spaced-apart, opposing relation to each other for receiving the ball therebetween; and (ii) a pair of anchors carried by said harness assembly, each of said pair of anchors having a pocket for receiving a respective one of two opposing ends of the luminescent member therein, thereby retaining the luminescent member in a tensioned condition relative to the harness assembly when the harness assembly is in use;

(b) providing a luminescent member having opposing ends, each of said ends for being removably positioned within said pocket on each of the respective anchors;

(c) positioning said harness assembly on the ball; and (d) positioning the opposing ends of the luminescent member within respective pockets on the pair of anchors, thereby illuminating the ball.

19. A method of illuminating a ball according to claim 18, and further comprising the step of providing a ball for receiving the harness assembly thereon.

* * * * *